US008167110B2

(12) United States Patent
Hibari et al.

(10) Patent No.: US 8,167,110 B2
(45) Date of Patent: May 1, 2012

(54) COIN DISCRIMINATION APPARATUS

(75) Inventors: Eiko Hibari, Kazo (JP); Masataka Takahashi, Matsudo (JP); Takaaki Nakazawa, Kawasaki (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 150 days.

(21) Appl. No.: 12/394,485

(22) Filed: Feb. 27, 2009

(65) Prior Publication Data

US 2009/0223778 A1 Sep. 10, 2009

(30) Foreign Application Priority Data

Mar. 5, 2008 (JP) ..... P2008-054844

(51) Int. Cl.
*G07D 5/08* (2006.01)

(52) U.S. Cl. ..... 194/317; 194/318

(58) Field of Classification Search ..... 194/317, 194/318, 329, 331, 320, 328, 330, 332, 335, 194/344, 214; 73/163; 453/7, 56
See application file for complete search history.

(56) References Cited

U.S. PATENT DOCUMENTS 4,271,855 A * 6/1981 Ueda ..... 453/11
5,236,339 A * 8/1993 Nishiumi et al. ..... 194/343
5,263,566 A 11/1993 Nara et al.
6,668,999 B2 * 12/2003 Ohtomo ..... 194/318
7,073,654 B2 * 7/2006 Matubara et al. ..... 194/318

FOREIGN PATENT DOCUMENTS

| | | |
|---|---|---|
| GB | 2 323 200 A | 9/1998 |
| GB | 2 368 443 A | 5/2002 |
| JP | 2007-048201 | 2/2007 |
| KR | 2001-0031644 | 4/2001 |
| WO | WO 99/23615 | 5/1999 |
| WO | WO 99/23616 | 5/1999 |
| WO | WO 00/25274 A1 | 5/2000 |

OTHER PUBLICATIONS

Non-Final Rejection and English Translation for corresponding Korean Application No. 10-2009-0017121, mailed Oct. 30, 2010, 5 pages.

* cited by examiner

*Primary Examiner* — Mark Beauchaine
(74) *Attorney, Agent, or Firm* — Nixon & Vanderhye P.C.

(57) ABSTRACT

A coin discrimination apparatus according to the present invention which discriminates a bimetallic coin having a ring part, and a core part provided on an inner side of the ring part and composed of a different material from that of the ring part, includes: a conveyor which conveys the bimetallic coin; a ring sensor which is arranged at a position where only the ring part of the bimetallic coin conveyed by the conveyor transits, and which detects magnetic properties; and a core sensor which is arranged at a position where the core part of the bimetallic coin conveyed by the conveyor transit, and which detects magnetic properties.

9 Claims, 3 Drawing Sheets

COIN DISCRIMINATION APPARATUS

BACKGROUND OF THE INVENTION

1. Field of the Invention

The present invention relates to a coin discrimination apparatus which conducts discrimination of bimetallic coins.

Priority is claimed on Japanese Patent Application No. 2008-054844, filed Mar. 5, 2008, the content of which is incorporated herein by reference.

2. Description of Related Art

Japanese Unexamined Patent Application, First Publication No. 2007-48201 discloses technology relating to a coin discrimination apparatus which conducts discrimination of bimetallic coins. This coin discrimination apparatus causes oscillation of an oscillating-side coil at high frequency and low frequency, and detects the coin material and whether or not the coin is bimetallic based on variations in the high-frequency components and low-frequency components of the output signals of a receiving-side coil. Furthermore, this coin discrimination apparatus detects the thickness of the coin based on variation on the high frequency side and variations in the oscillation frequency on the low frequency side of the oscillating-side coil.

One of the purposes behind issuance of bimetallic coins was the prevention of counterfeiting, but many false coins of the bimetallic coin type have been discovered in recent years. With conventional coin discrimination apparatuses, there is the possibility of being unable to discriminate such counterfeit coins.

SUMMARY OF THE INVENTION

An object of the present invention is to provide a coin discrimination apparatus capable of discriminating counterfeit coins of the bimetallic coin type.

In order to achieve the aforementioned object, a coin discrimination apparatus according to the present invention which discriminates a bimetallic coin having a ring part, and a core part provided on an inner side of the ring part and composed of a different material from that of the ring part, includes: a conveyor which conveys the bimetallic coin; a ring sensor which is arranged at a position where only the ring part of the bimetallic coin conveyed by the conveyor transits, and which detects magnetic properties; and a core sensor which is arranged at a position where the core part of the bimetallic coin conveyed by the conveyor transit, and which detects magnetic properties.

According to this configuration, there is separately provided a ring sensor which is arranged at a position where only the ring part of the bimetallic coin conveyed by the conveyor transits, and which detects magnetic properties, and a core sensor which is arranged at a position where the core part of the bimetallic coin conveyed by the conveyor transits, and which detects magnetic properties. As a result, it is possible to detect magnetic properties at a position pertaining only to the ring part, and to detect magnetic properties at a position pertaining to the core part, thereby enabling discrimination of counterfeit coins of the bimetallic coin type.

In the coin discrimination apparatus of the present invention, a width of a transmitting sensor of the ring sensor may be smaller than that of the ring part.

According to this configuration, the width of the transmitting sensor of the ring sensor is smaller than that of the ring part. Consequently, the eddy current generated in the ring part by the excitation of this transmitting sensor is impeded from reaching the core part. Accordingly, as it is possible to mitigate the effects from excitation of the transmitting sensor of the ring sensor which extend to the core sensor, the magnetic properties of the core part can be satisfactorily detected.

In the coin discrimination apparatus of the present invention, a transmitting sensor of the ring sensor may be a sensor of a pot core type.

According to this configuration, the transmitting sensor of the ring sensor is a pot core type sensor. Consequently, the magnetic flux emitted from this transmitting sensor can be made to reach the ring part in the form of a small spot. Accordingly, the magnetic properties of the ring part can be satisfactorily detected.

In the coin discrimination apparatus of the present invention, a transmitting sensor of the ring sensor may be arranged at a position where an intermediate part of a unilateral portion of the ring part in a direction orthogonal to a conveyance direction of the conveyor transits, and a receiving sensor of the ring sensor may be arranged on an opposite side of the core part relative to the transmitting sensor in the direction orthogonal to the conveyance direction.

According to this configuration, the transmitting sensor of the ring sensor is arranged at a position where the intermediate part of a unilateral portion of the ring part in a direction orthogonal to the conveyance direction of the conveyor transits, and the receiving sensor of the ring sensor is arranged on the opposite side of the core part relative to the transmitting sensor in the direction orthogonal to the conveyance direction. Consequently, receipt of the effects of the magnetic flux emitted by the core part is impeded, thereby enabling satisfactory detection of the magnetic properties of the ring part.

DETAILED DESCRIPTION OF THE INVENTION

A coin discrimination apparatus according to one embodiment of the present invention is described below with reference to drawings.

Figure 1A:
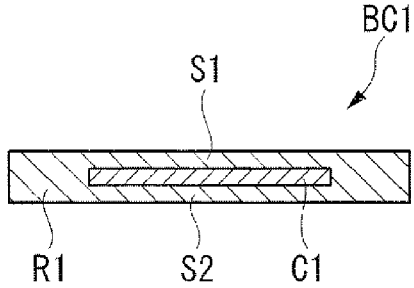
FIG. 1A and FIG. 1B are sectional views showing two types of bimetallic coin capable of being discriminated by a coin discrimination apparatus according to one embodiment of the present invention.
Figure 1B:
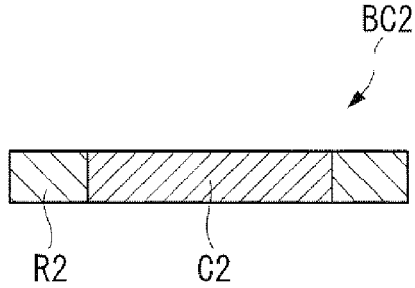

The coin discrimination apparatus of the present embodiment conducts discrimination with respect to a bimetallic coin BC1 shown in FIG. 1A and a bimetallic coin BC2 shown in FIG. 1B. The bimetallic coin BC1 has a clad structure, and is formed by a ring part R1, a core part C1, and a pair of surface layers S1 and S2. The ring part R1 has a toroidal shape, and is composed of an alloy of one material. The core part C1 has a discoid shape, is composed of an alloy of another material different from that of the ring part R1, and is provided only at the center in the thickness direction on the inner side in the radial direction of the ring part R1. The pair of surface layers S1 and S2 are provided at both sides in the thickness direction of the core part C1, are composed of an alloy of the same material as the ring part R1, and are formed without interfacial boundaries relative to the ring part R1. The bimetallic coin BC2 is only formed by a ring part R2, and a core part C2. The ring part R1 has a discoid shape, and is composed of an alloy of one material. The core part C2 is composed of an alloy of another material different from that of the ring part R2, and is provided on the inner side in the radial direction of the ring part R2. The below description relates to an example of the case where discrimination is conducted with respect to the bimetallic coin BC1 with the clad structure shown in FIG. 1A where the core part C1 is internally embedded. In the following description, with respect to the pair of surface layers S1 and S2, the one which is on top at the time of detection is referred to as the upper surface layer S1, while the other which is underneath at the time of detection is referred to as the lower surface layer S2.

Figure 2A:
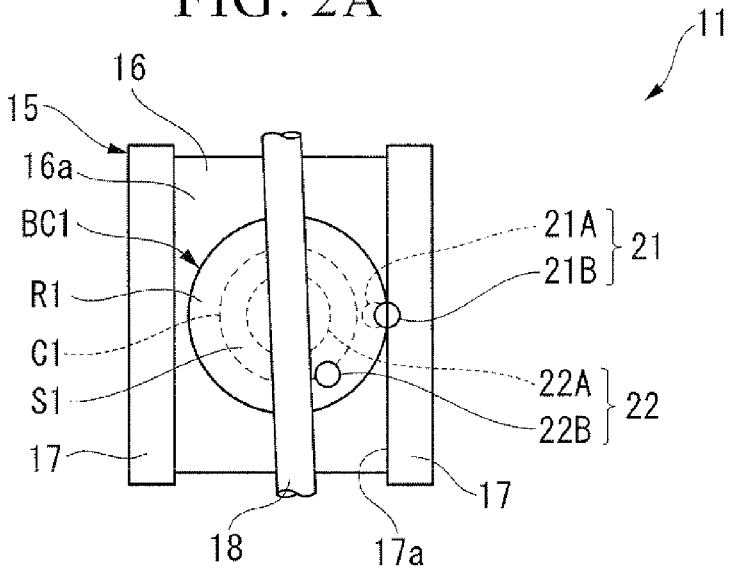
FIG. 2A is a plan view showing the coin discrimination apparatus according to the embodiment of the present invention.
Figure 2B:
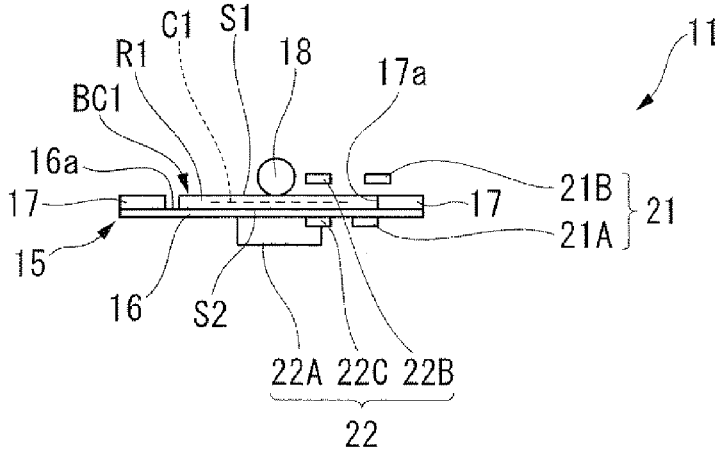
FIG. 2B is a sectional view showing the coin discrimination apparatus according to the embodiment of the present invention.

The coin discrimination apparatus 11 of the present embodiment is combined with coin processing equipment such as a coin receiver, coin receiver/dispenser, and the like. Although not illustrated in the drawings, the coin processing equipment separates loose coins, which are put into a receiving opening from the outside, into individual coins, conveys the coins, and stores them as necessary. As shown in FIG. 2A and FIG. 2B, the coin discrimination apparatus 11 includes a conveyor 15 which conveys the coins one-by-one.

This conveyor 15 has a conveyor path 16, a pair of conveyor guides 17, and a conveyor belt 18. The conveyor path 16 has a laminar shape, and configures a flat conveyor face 116*a* whose upper face extends laterally, and which conducts the bottom face of the bimetallic coin BC1. The two conveyor guides 17 are respectively arranged on the two sides in the lateral direction on the conveyor face 16*a*. The conveyor belt 18 is arranged at the upper side of the conveyor face 16*a* so as to open prescribed intervals, and is slanted so that it draws nearer to one of the conveyor guides 17 toward the downstream side in the conveyance direction. Due to the slanting of the conveyor belt 18, the conveyor 15 conveys the bimetallic coin BC1 so that it is constantly in contact with a guide wall face 17*a* that runs vertically along the conveyor guide 17 of one side in the lateral direction. In short, the conveyor 15 conducts a unilaterally biased conveyance in which the bimetallic coin BC1 is conveyed in a state where it is drawn toward one of the lateral sides.

The coin discriminations apparatus 11 has a ring sensor 21 and core sensor 22. The ring sensor 21 detects the magnetic properties of the ring part R1 side of the bimetallic coin BC1. Within the scope of the unilaterally biased conveyance conducted by the conveyor 15, the ring sensor 21 is arranged at a position where in a planar view only the ring part R1 of the bimetallic coin BC1 transits which is moved such that its position in the lateral direction is determined by the guide wall face 17*a*. The core sensor 22 detects the magnetic properties of the core part C1 side of the bimetallic coin BC1. The core sensor 22 is arranged at a position where in a planar view only the core part C1 and two surface layers S1 and S2 of the bimetallic coin BC1 transit which is moved such that its position in the lateral direction is determined by the guide wall face 17*a*.

The ring sensor 21 has a transmitting sensor 21A and a receiving sensor 21B. The transmitting sensor 21A is arranged on the underside of the conveyor face 16*a*, and oscillates. On the topside of the conveyor face 16*a*, the receiving sensor 21B is arranged opposite the transmitting sensor 21A with interposition of the bimetallic coin BC1, and receives signals. The transmitting sensor 21A and receiving sensor 21B are arranged with alignment of their positions in the conveyance direction of the conveyor 15.

The diameter of the transmitting sensor 21A of the ring sensor 21 is formed smaller than the width in the radial direction of a unilateral portion of the ring part R1 of the bimetallic coin BC1 in order to prevent as much as possible the eddy current generated in the ring part R1 by excitation of the transmitting sensor 21A from reaching the core part C1, upper surface layer S1, and lower surface layer S2. As this transmitting sensor 21A, a small pot core sensor is adopted so that emitted magnetic flux reaches the ring part R1 in the form of a small spot. The distance from the guide wall face 17*a* to the center of the transmitting sensor 21A is set so as to approximately match the distance from the guide wall face 17*a* to the center position of the width of the portion of the ring part R1 of the bimetallic coin BC1 which contacts the guide wall face 17*a*. As a result, in a planar view, the transmitting sensor 21A of the ring sensor 21 is disposed at a position where the intermediate part of a unilateral portion of the ring part R1 of the bimetallic coin BC1 that is conveyed with guidance from the guide wall face 17*a*, in a direction along the conveyor face 16*a* and orthogonal to the conveyance direction of the conveyor 15, transits unfailingly.

The diameter of the receiving sensor 21B of the ring sensor 21 is formed smaller than the width in the radial direction of a unilateral portion of the ring part R1 of the bimetallic coin BC1 so that it does not sustain the effects of the magnetic flux emitted from the core part C1, upper surface layer S1, and lower surface layer S2. The center of the receiving sensor 21B of the ring sensor 21 is arranged at the position of the guide wall face 17*a*. As a result, in a planar view, the receiving sensor 21B of the ring sensor 21 is disposed on the opposite side of the core part C1 relative to the transmitting sensor 21A in a direction along the conveyor face 16*a* and orthogonal to the conveyance direction of the conveyor 15. It is also acceptable to align the position of the receiving sensor 21B of the ring sensor 21 in a planar view with the transmitting sensor 21A. With respect to the normal excitation frequency for the ring sensor 21 used for the ring part R1 of the bimetallic coin BC1, several 10 KHz to several 100 KHz is preferable. It is also possible to use a reflective magnetic sensor as the ring sensor 21 if the magnetic flux emitted by the transmitting sensor 21A has a sufficiently small spot form so as not to reach the core part C1, upper surface layer S1, and lower surface layer S2.

The core sensor 22 has a core internal layer sensor 22A, core upper surface layer sensor 22B, and core lower surface layer sensor 22C. The core internal layer sensor 22A is disposed on the underside of the conveyor face 16*a*. The core upper surface layer sensor 22B is disposed on the topside of the conveyor face 16*a*. The core lower surface layer sensor 22C is disposed on the underside of the conveyor face 16*a*.

The distance from the guide wall face 17*a* to the center of the core internal layer sensor 22A is set so as to approximately match the distance from the guide wall face 17*a* to the center position of the core part C1 of the bimetallic coin BC1 which contacts the guide wall face 17*a*. As a result, in a planar view, the core internal layer sensor 22A is arranged at a position which is unfailingly transited by the intermediate part of the core part C1 of the bimetallic coin BC1 conveyed with guidance from the guide wall face 17*a*. The position of the core internal layer sensor 22A in the conveyance direction of the conveyor 15 is aligned with that of the transmitting sensor 21A and receiving sensor 21B of the ring sensor 21.

This core internal layer sensor 22A is a reflective magnetic sensor, and is excited to a frequency level at which the eddy current generated inside the bimetallic coin BC1 fully reaches the alloy composing the core part C1. The core internal layer sensor 22A discriminates the magnetic properties of the core part C1 by measuring inductance variation when the bimetallic coin BC1 approaches it from above. It is preferable that the normal excitation frequency for the core internal layer sensor 22A used for the core part C1 of the bimetallic coin BC1 be several 10 KHz to several 100 KHz. It is also acceptable to configure the core internal layer sensor 22A with a transmissive magnetic sensor, instead of a reflective magnetic sensor.

The core upper surface layer sensor 22B and core lower surface layer sensor 22C are arranged so that their positions are mutually aligned in the conveyance direction of the conveyor 15, and so that their positions are aligned in the direction along the conveyor face 16*a* and orthogonal to the conveyance direction of the conveyor 15. The distance of the core upper surface layer sensor 22B and core lower surface layer sensor 22C from the guide wall face 17*a* is set to approximately match the distance to an intermediate position of the bimetallic coin BC1 which contacts the guide wall face 17*a*. As a result, in a planar view, the core upper surface layer sensor 22B and core lower surface layer sensor 22C are disposed at positions where the intermediate parts of the upper surface layer S1 and lower surface layer S2 of the bimetallic coin BC1 that is conveyed with guidance from the guide wall face 17*a*, in a direction along the conveyor face 16*a* and orthogonal to the conveyance direction of the conveyor 15, transit unfailingly. The core upper surface layer sensor 22B and core lower surface layer sensor 22C are disposed farther toward the downstream side in the conveyance direction of the conveyor 15 than is the core internal layer sensor 22A.

The core upper surface layer sensor 22B and core lower surface layer sensor 22C are reflective magnetic sensors. The core upper surface layer sensor 22B is excited to a frequency level at which the eddy current generated inside the bimetallic coin BC1 reaches only the alloy composing the upper surface layer S1. The core upper surface layer sensor 22B discriminates the magnetic properties of the upper surface layer S1 by measuring inductance variation when the bimetallic coin BC1 approaches it from underneath. The core lower surface layer sensor 22C is excited to a frequency level at which the eddy current generated inside the bimetallic coin BC1 reaches only the alloy composing the lower surface layer S2. The core lower surface layer sensor 22C discriminates the magnetic properties of the lower surface layer S2 by measuring inductance variation when the bimetallic coin BC1 approaches it from above. It is preferable that the normal excitation frequency for the core upper surface layer sensor 22B and core lower surface layer sensor 22C used for the upper surface layer S1 and lower surface layer S2 of the bimetallic coin BC1 be several 10 KHz to several 100 KHz. The core upper surface layer sensor 22B and core lower surface layer sensor 22C are made smaller than the diameter of the corresponding upper surface layer S1 and lower surface layer S2, and are given a size at which no effects are sustained from the ring part R1.

Figure 3:
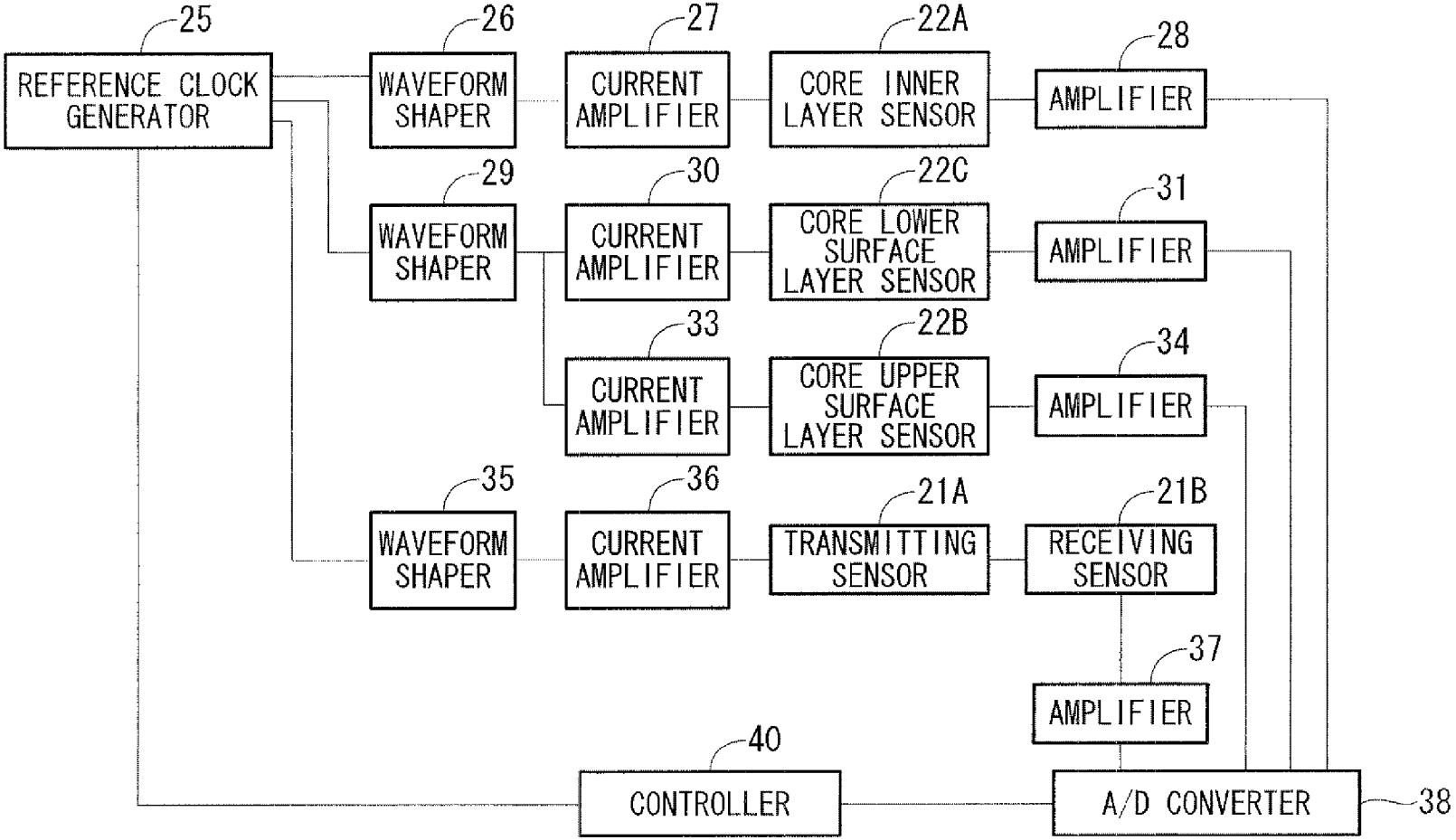
FIG. 3 is a control system block diagram showing the coin discrimination apparatus according to the embodiment of the present invention.

In order to conduct detection by the aforementioned core internal layer sensor 22A, ring sensor 21, core upper surface layer sensor 22B and core lower surface layer sensor 22C, as shown in FIG. 3, the coin discrimination apparatus 11 includes a reference clock generator 25; a waveform shaper 26, current amplifier 27 and amplifier 28 for the core internal layer sensor 22A; a waveform shaper 29 for the core upper surface layer sensor 22B and core lower surface layer sensor 22C; a current amplifier 30 and amplifier 31 for the core lower surface layer sensor 22C; a current amplifier 33 and amplifier 34 for the core upper surface layer sensor 22B; a waveform shaper 35 and current amplifier 36 for the transmitting sensor 21A of the ring sensor 21; an amplifier 37 for the receiving sensor 21B of the ring sensor 21; an A/D converter 38 connected to the amplifiers 28, 31, 34 and 37; and a controller 40.

At the time of passage of the subject coin, the controller 40 compares preset tolerance ranges with the respective magnetic properties respectively detected by, for example, the core internal layer sensor 22A, core upper surface layer sensor 22B, core lower surface layer sensor 22C and receiving sensor 21B of the ring sensor 21. In the case where the controller 40 determines that all magnetic properties are within the tolerance ranges, the determination is made that the subject coin is a true bimetallic coin BC1. On the other hand, when any of the magnetic properties deviate from the tolerance ranges, the controller 40 makes the determination that the subject coin is not a true bimetallic coin BC1.

According to the coin discrimination apparatus 11 of the first embodiment described above, there is separately provided a ring sensor 21 which is arranged at a position where the ring part R1 of the bimetallic coin BC1 conveyed by the conveyor 15 only transits, and which detects magnetic properties, and a core sensor 22 which is arranged at a position where the core part C1 of the bimetallic coin BC1 conveyed by the conveyor 15 transits, and which detects magnetic properties. According to this configuration, it is possible to detect magnetic properties at a position pertaining only to the ring part R1, and magnetic properties at a position pertaining to the core part C1, thereby enabling discrimination of counterfeit coins of the bimetallic coin type.

Moreover, the width of the transmitting sensor 21A of the ring sensor 21 is smaller than that of the ring part R1. According to this configuration, it is possible to inhibit the eddy current generated in the ring part R1 by excitation of the transmitting sensor 21A of the ring sensor 21 from reaching the core part C1. Accordingly, as it is possible to mitigate the effects from excitation of the transmitting sensor 21A of the ring sensor 21 which extend to the core sensor 22, the magnetic properties of the core part C1 can be satisfactorily detected.

Moreover, the transmitting sensor 21A of the ring sensor 21 is a pot core sensor. According to this configuration, it is possible to have the magnetic flux emitted from the transmitting sensor 21A of the ring sensor 21 reach the ring part R1 in the form of a small spot. Accordingly, the magnetic properties of the ring part R1 can be satisfactorily detected.

Moreover, the transmitting sensor 21A of the ring sensor 21 is disposed at a position where the intermediate part of a unilateral portion of the ring part R1 in a direction orthogonal to the conveyance direction of the conveyor 15 transits, and the receiving sensor 21B of the ring sensor 21 is disposed on the opposite side of the core part C1 relative to the transmitting sensor 21A in a direction orthogonal to the conveyance direction. According to this configuration, receipt of the effects of the magnetic flux emitted from the core part C1 is inhibited. Consequently, it is possible to satisfactorily detect the magnetic properties of the ring part R1.

Figure 4:
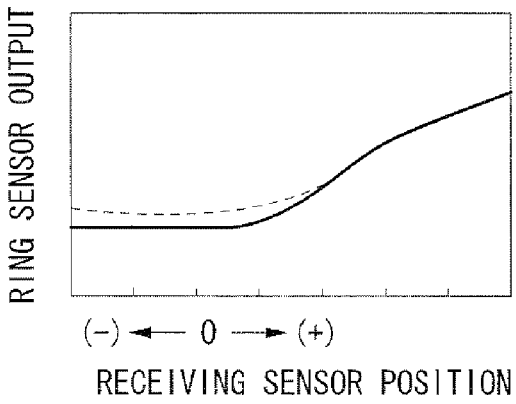
FIG. 4 is a characteristic diagram showing the output of a ring sensor relative to the position of a receiving sensor in the coin discrimination apparatus according to the embodiment of the present invention.

FIG. 4 is the result of a comparison of how output changes according to the position of the receiving sensor 21B of the ring sensor 21 using the bimetallic coin BC1 and a coin which only has the ring part R1 without the upper surface layer S1, lower surface layer S2, and core part C1 of the bimetallic coin BC1. The horizontal axis of FIG. 4 shows the position of the receiving sensor 21B. A position of 0 indicates that the center of the receiving sensor 21B and the center of the transmitting sensor 21A are positioned on the same axis. The + direction indicates that the receiving sensor 21B is positioned on the opposite side of the core part C1 relative to the transmitting sensor 21A. The – direction indicates that the receiving sensor 21B is positioned on the core part C1 side relative to the transmitting sensor 21A. The output of the ring sensor 21 shown by the vertical axis of FIG. 4 indicates the quantity of magnetic flux which is generated by the eddy current generated inside the coin by the excitation of the transmitting sensor 21A, and which is transmitted through the coin to reach the receiving sensor 21B. As is clear from FIG. 4, when the center of the transmitting sensor 21A and the center of the receiving sensor 21B are positioned on the same axis (when the position of the horizontal axis is 0), the output obtained from measurement of the bimetallic coin BC1 indicated by a solid line differs from the output obtained from measurement of the coin with only the ring part R1 indicated by the broken line. This is because the ring sensor 21 sustains the effects of magnetic flux emitted from the upper surface layer S1, lower surface layer S2, and core part C1. In contrast, when the position of the ring receiving sensor 21B deviates at or above a prescribed value in the + direction, it is clear that the magnetic properties of the bimetallic coin BC1 and the magnetic properties of the coin with only the ring part R1 coincide. In short, it is clearly better to arrange the receiving sensor 21B of the ring sensor 21 on the opposite side of the core part C1 relative to the transmitting sensor 21A. As the optimal position of the receiving sensor 21B correlates with the shape of the respective sensors and the placement of the transmitting sensor 21A relative to the position of the coin, an optimal position of the receiving sensor 21B is selected according to the shape and placement of the respective sensors.

Figure 5A:
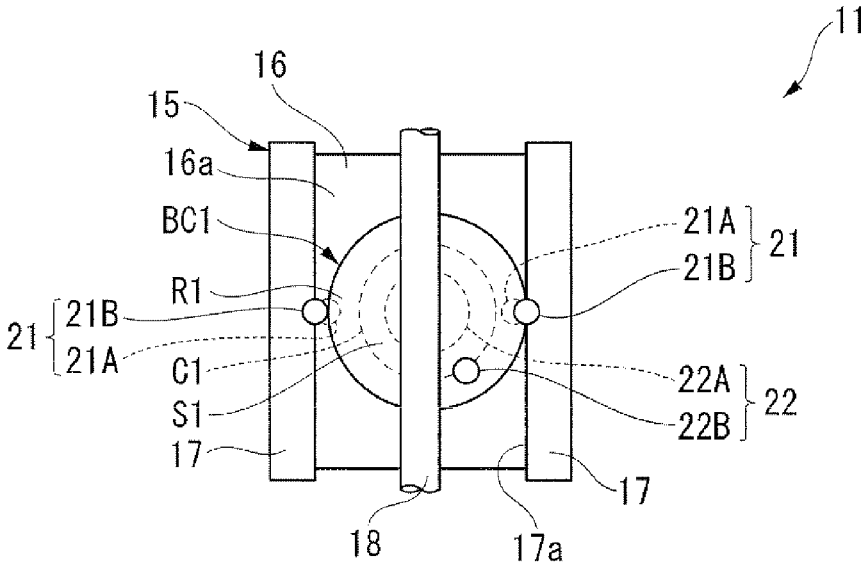
FIG. 5A is a plan view showing a variation of the coin discrimination apparatus according to the embodiment of the present invention.
Figure 5B:
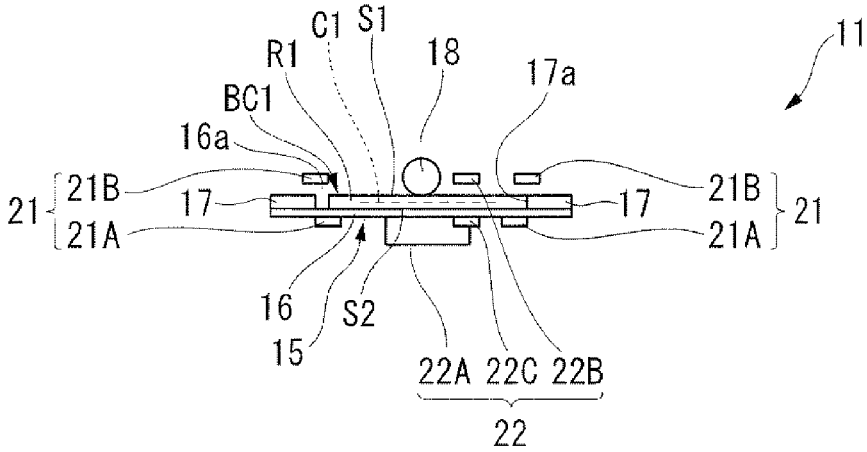
FIG. 5B is a sectional view showing the variation of the coin discrimination apparatus according to the embodiment of the present invention.

In the foregoing, a description was given for the case where discrimination is conducted while the bimetallic coin BC1 is conveyed in a unilaterally biased manner. However, it is also acceptable to enable the bimetallic coin BC1 to move between a lateral pair of conveyor guides 17. In this case, as shown in FIG. 5A and FIG. 5B, the ring sensor 21 is configured from complementary sensors which are provided as a laterally symmetrical pair. If the outputs of these lateral ring sensors 21 are added together, it is possible to stably obtain the magnetic properties of the ring part R1.

It is also acceptable to combine the coin discrimination apparatus 11 with a diameter sensor which detects the diameter of the bimetallic coin BC1 an image sensor which detects either the front or back image of the bimetallic coin BC1, an engraving sensor which detects engravings such as indentations on the circumferential face of the bimetallic coin BC1, and so on.

When conducting discrimination of a bimetallic coin BC2 provided only with the core part C2 on the inner side of the ring part R2 as shown in FIG. 1B, it is unnecessary to include the core upper surface layer sensor 22B and the core lower surface layer sensor 22C in the aforementioned core sensor 22.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A coin discrimination apparatus which discriminates a bimetallic coin having a ring part, and a core part provided on an inner side of the ring part and composed of a different material from that of the ring part, comprising:

a conveyor which conveys the bimetallic coin, the conveyor including a conveyor path which has a flat conveyor face, an upper face of the conveyor face extending laterally, the conveyor face guiding a bottom face of the bimetallic coin, a pair of conveyor guides which are respectively arranged on two sides in a direction orthogonal to a conveyance direction of said conveyor, and are arranged on the conveyor face, and a conveyor belt which is arranged at an upper side of the conveyor face so as to open a prescribed interval between the conveyor belt and the conveyor face to convey bimetallic coin;

a pair of ring sensors which are arranged at positions where only the ring part of the bimetallic coin conveyed by said conveyor transits, and which detect magnetic properties, the pair of ring sensors having similar configurations to each other, the pair of ring sensors arranged laterally symmetrically with each other with respect to the conveyance direction, each of the ring sensors including a transmitting sensor which oscillates and a receiving sensor which receives signals; and a core sensor which is arranged at a position where the core part of the bimetallic coin conveyed by said conveyor transits, and which detects magnetic properties, the core sensor arranged between the pair of ring sensors with respect to the direction orthogonal to the conveyance direction, wherein the transmitting sensor is arranged on an underside of the conveyor face, and the receiving sensor is arranged on the upper side of the conveyor face and arranged opposite the transmitting sensor, a center of the receiving sensor of one of the ring sensors is arranged at a position of a guide wall face running vertically along one of the conveyor guides, and a center of the receiving sensor of the other ring sensor is arranged at a position of a guide wall face running vertically along the other conveyor guide.

2. The coin discrimination apparatus according to claim 1, wherein a width of a transmitting sensor of said ring sensor is smaller than that of the ring part.

3. The coin discrimination apparatus according to claim 2, wherein the transmitting sensor is arranged at a position where an intermediate part of a unilateral portion of said ring part in the direction orthogonal to the conveyance direction of said conveyor transits, and the receiving sensor is arranged on an opposite side of said core part relative to said transmitting sensor in the direction orthogonal to the conveyance direction.

4. The coin discrimination apparatus according to claim 1, wherein a transmitting sensor of said ring sensor is a sensor of a pot core type.

5. The coin discrimination apparatus according to claim 2, wherein a transmitting sensor of said ring sensor is a sensor of a pot core type.

6. The coin discrimination apparatus according to claim 5, wherein the transmitting sensor is arranged at a position where an intermediate part of a unilateral portion of said ring part in the direction orthogonal to the conveyance direction of said conveyor transits, and the receiving sensor is arranged on an opposite side of said core part relative to said transmitting sensor in the direction orthogonal to the conveyance direction.

7. The coin discrimination apparatus according to claim 4, wherein the transmitting sensor is arranged at a position where an intermediate part of a unilateral portion of said ring part in the direction orthogonal to the conveyance direction of said conveyor transits, and the receiving sensor is arranged on an opposite side of said core part relative to said transmitting sensor in the direction orthogonal to the conveyance direction.

8. The coin discrimination apparatus according to claim 1, wherein the transmitting sensor is arranged at a position where an intermediate part of a unilateral portion of said ring part in the direction orthogonal to the conveyance direction of said conveyor transits, and the receiving sensor is arranged on an opposite side of said core part relative to said transmitting sensor in the direction orthogonal to the conveyance direction.

9. The coin discrimination apparatus according to claim 1, wherein a center of the transmitting sensor of the one of the ring sensors is arranged nearer to the conveyor belt than the center of the receiving sensor of the one of the ring sensors, and a center of the transmitting sensor of the other ring sensor is arranged nearer to the conveyor belt than the center of the receiving sensor of the other ring sensor.

* * * * *